US009869429B2

(12) United States Patent
Drube et al.

(10) Patent No.: US 9,869,429 B2
(45) Date of Patent: Jan. 16, 2018

(54) BULK CRYOGENIC LIQUID PRESSURIZED DISPENSING SYSTEM AND METHOD

(71) Applicant: Chart Industries, Inc., Garfield Heights, OH (US)

(72) Inventors: Paul Drube, Burnsville, MN (US); Timothy Neeser, Savage, MN (US); Tyler Stousland, Burnsville, MN (US)

(73) Assignee: Chart Industries, Inc., Garfield Heights, OH (US)

( * ) Notice: Subject to any disclaimer, the term of this patent is extended or adjusted under 35 U.S.C. 154(b) by 889 days.

(21) Appl. No.: 13/782,922

(22) Filed: Mar. 1, 2013

(65) Prior Publication Data

US 2013/0305745 A1 Nov. 21, 2013

Related U.S. Application Data

(63) Continuation-in-part of application No. 13/216,666, filed on Aug. 24, 2011.
(Continued)

(51) Int. Cl.
*F17C 13/02* (2006.01)
*F17C 7/02* (2006.01)
*F17C 7/04* (2006.01)

(52) U.S. Cl.
CPC ..... *F17C 7/02* (2013.01); *F17C 7/04* (2013.01); *F17C 2201/0109* (2013.01);
(Continued)

(58) Field of Classification Search
CPC ..... F17C 7/02; F17C 7/04; F17C 2201/032; F17C 2201/0109; F17C 2201/054;
(Continued)

(56) References Cited

U.S. PATENT DOCUMENTS 2,632,306 A * 3/1953 Ruff ..... F24F 5/00 165/240
3,108,446 A 10/1963 Sohda et al.
(Continued)

FOREIGN PATENT DOCUMENTS

EP 2 453 160 A2 5/2012
WO WO 2004/005791 A2 1/2004

OTHER PUBLICATIONS

European Search Report from corresponding European Patent Application No. 11250739.7 dated Dec. 17, 2013.
(Continued)

*Primary Examiner* — Keith Raymond
(74) *Attorney, Agent, or Firm* — Cook Alex Ltd.; R. Blake Johnston

(57) ABSTRACT

A system for dispensing cryogenic liquid to a use point includes a bulk tank containing a supply of carbon dioxide or other cryogenic liquid and a pressure builder that is in communication with the tank via a pressure building valve. The pressure builder uses heat exchangers to vaporize a portion of the cryogenic liquid as needed to pressurize the bulk tank. The pressurized cryogenic liquid is dispensed through a dispensing line running from the bottom of the tank. A vent valve also vents vapor from the tank to control pressure. Operation of the vent and pressure building valves is automated by a controller that receives data from sensors. The controller determines the required saturation pressure for the tank and varies the tank pressure to match and provide a generally constant outlet pressure depending on conditions of the cryogenic liquid.

18 Claims, 17 Drawing Sheets

Related U.S. Application Data

(60) Provisional application No. 61/376,884, filed on Aug. 25, 2010.

(52) U.S. Cl.
CPC .. *F17C 2201/032* (2013.01); *F17C 2201/054* (2013.01); *F17C 2203/032* (2013.01); *F17C 2203/0391* (2013.01); *F17C 2203/0629* (2013.01); *F17C 2203/0639* (2013.01); *F17C 2203/0643* (2013.01); *F17C 2205/018* (2013.01); *F17C 2205/0326* (2013.01); *F17C 2205/0332* (2013.01); *F17C 2205/0335* (2013.01); *F17C 2205/0355* (2013.01); *F17C 2221/013* (2013.01); *F17C 2221/014* (2013.01); *F17C 2223/0161* (2013.01); *F17C 2223/0169* (2013.01); *F17C 2223/033* (2013.01); *F17C 2223/041* (2013.01); *F17C 2223/046* (2013.01); *F17C 2225/0161* (2013.01); *F17C 2225/0169* (2013.01); *F17C 2227/0107* (2013.01); *F17C 2227/0355* (2013.01); *F17C 2227/0374* (2013.01); *F17C 2250/032* (2013.01); *F17C 2250/036* (2013.01); *F17C 2250/043* (2013.01); *F17C 2250/0408* (2013.01); *F17C 2250/0434* (2013.01); *F17C 2250/0439* (2013.01); *F17C 2250/0491* (2013.01); *F17C 2250/0495* (2013.01); *F17C 2250/0626* (2013.01); *F17C 2250/0631* (2013.01); *F17C 2250/077* (2013.01); *F17C 2260/024* (2013.01); *F17C 2270/05* (2013.01)

(58) Field of Classification Search
CPC ..... F17C 2203/0391; F17C 2203/0629; F17C 2203/0643; F17C 2203/0639; F17C 2205/018; F17C 2205/0332; F17C 2205/0326; F17C 2227/0107; F17C 2250/032; F17C 2250/043; F17C 2205/0335; F17C 2205/0355; F17C 2221/014; F17C 2223/0161; F17C 2225/0161; F17C 2223/46; F17C 2225/0169; F17C 2223/0169; F17C 2250/0626; F17C 2250/0408; F17C 2250/061; F17C 13/02; F17C 13/025
See application file for complete search history.

(56) References Cited

U.S. PATENT DOCUMENTS

| | | | | |
|---|---|---|---|---|
| 3,230,729 | A * | 1/1966 | Eber | F25B 43/043 62/195 |
| 3,419,174 | A | 12/1968 | Engdahl | |
| 4,187,689 | A | 2/1980 | Selcukoglu et al. | |
| 4,296,610 | A | 10/1981 | Davis | |
| 4,888,955 | A | 12/1989 | Tyree et al. | |
| 5,415,001 | A | 5/1995 | Powars | |
| 5,465,583 | A * | 11/1995 | Goode | F17C 5/007 141/4 |
| 5,590,535 | A | 1/1997 | Rhoades | |
| RE35,874 | E | 8/1998 | Neeser et al. | |
| 6,058,713 | A * | 5/2000 | Bowen | B23K 9/173 62/46.1 |
| 6,368,264 | B1 | 4/2002 | Tyree, Jr. | |
| 6,505,469 | B1 * | 1/2003 | Drube | F17C 7/04 62/48.1 |
| 6,631,615 | B2 * | 10/2003 | Drube | F17C 5/007 62/50.4 |
| 7,581,405 | B2 | 9/2009 | Higginbotham et al. | |
| 2003/0126867 | A1 * | 7/2003 | Drube | F17C 7/04 62/50.2 |
| 2005/0056027 | A1 | 3/2005 | White | |
| 2005/0132719 | A1 | 6/2005 | Svensson et al. | |
| 2007/0215524 | A1 | 9/2007 | Stell et al. | |
| 2009/0193817 | A1 | 8/2009 | Germain et al. | |
| 2010/0241371 | A1 * | 9/2010 | Ammouri | F17C 13/021 702/55 |

OTHER PUBLICATIONS

File History of U.S. Appl. No. 13/216,666, filed Aug. 24, 2011.
European Search Report dated Dec. 9, 2015 for European Application No. EP 14157104.

* cited by examiner

BULK CRYOGENIC LIQUID PRESSURIZED DISPENSING SYSTEM AND METHOD

CLAIM OF PRIORITY

This application is a continuation-in-part of U.S. patent application Ser. No. 13/216,666, filed Aug. 24, 2011, currently pending.

FIELD OF THE INVENTION

The present invention generally relates to systems for storing and dispensing fluids and, more particularly, to a bulk cryogenic liquid pressurized dispensing system and method.

BACKGROUND

It is well known that cryogenic liquids, or liquids having similar properties, have found great use in industrial refrigeration and freezing, cryo-biological storage repository and lab test applications. Cryogenic liquids are typically stored in thermally insulated bulk tanks which consist of an inner vessel mounted inside, and thermally isolated from, an outer vessel. The liquid is then directed from the tank through thermally isolated pipes to a supply point where it is used for a variety of applications such as industrial, medical, or food processing.

Prior art bulk tanks typically use a pressure regulator at the top of the bulk tank. Such a system is limited in its flexibility. When the tank is full there is a certain amount of liquid head pressure. This head pressure is added to the tank vapor pressure and this is the supply pressure out of the tank. For some applications it may be important to maintain a constant supply pressure. As the liquid level in the tank drops from usage the vapor pressure in the tank needs to increase to compensate for the decrease in head pressure.

A mechanical pressure regulator is set to open when the pressure in the bulk tank drops below a set point and closes when it rises above the set point. The regulator is usually set to provide enough pressure inside the tank to operate at low liquid levels. This means that the supply pressure will be higher when the tank is full and drop off as the liquid level drops. As a result, a user may experience product losses or loss in efficiency near the bottom of the tank. This is not ideal for high flow rates where the condition of the supplied cryogenic liquid is important.

Failure to install a properly designed system for storing and dispensing cryogenic liquid with consistent quality causes wasted energy in lost cooling power. The poor control of the liquid conditions allows the outlet pressure to fluctuate so wildly that many times customers cannot utilize the lower one-third of the tank's capacity. The primary culprit of this complaint stems from a reduction in tank outlet pressure (tank vapor+liquid head pressure) at the liquid withdrawal point. This leads to a reduction in liquid flow rate at the application and as a result, inconsistent cooling.

In applications such as food freezing where the product is moving at a specified rate in the tunnel, it's critical that the quality of the cryogenic liquid being dispensed is consistent so the process can be tuned for maximum production throughput. If it becomes out of tune from liquid conditions changing at the application, the only recourse a plant manager has control over (other than slowing down production) is to call their liquid supplier and expedite the tank refill in order to restore the liquid to pre-tuned conditions. Not only is this an emergency delivery, but it's usually before the desired refill point so the tank can't take a full trailer load. The fresh liquid resolves the problem because it is usually colder and lowers the overall liquid saturation pressure, but more importantly, the pressure at the bottom of the tank is increased so the tuned liquid nitrogen flow rate is restored. A simple electrical analogy is like a voltage outage has just been restored. The cryogenic food freezer, like any electrical appliance wants to run on a constant supply pressure or voltage, so the liquid nitrogen flow rate or amperage draw remains constant.

A need therefore exists for a bulk cryogenic liquid pressurized dispensing system and method that addresses the above issues.

DETAILED DESCRIPTION OF EMBODIMENTS

Figure 1A:
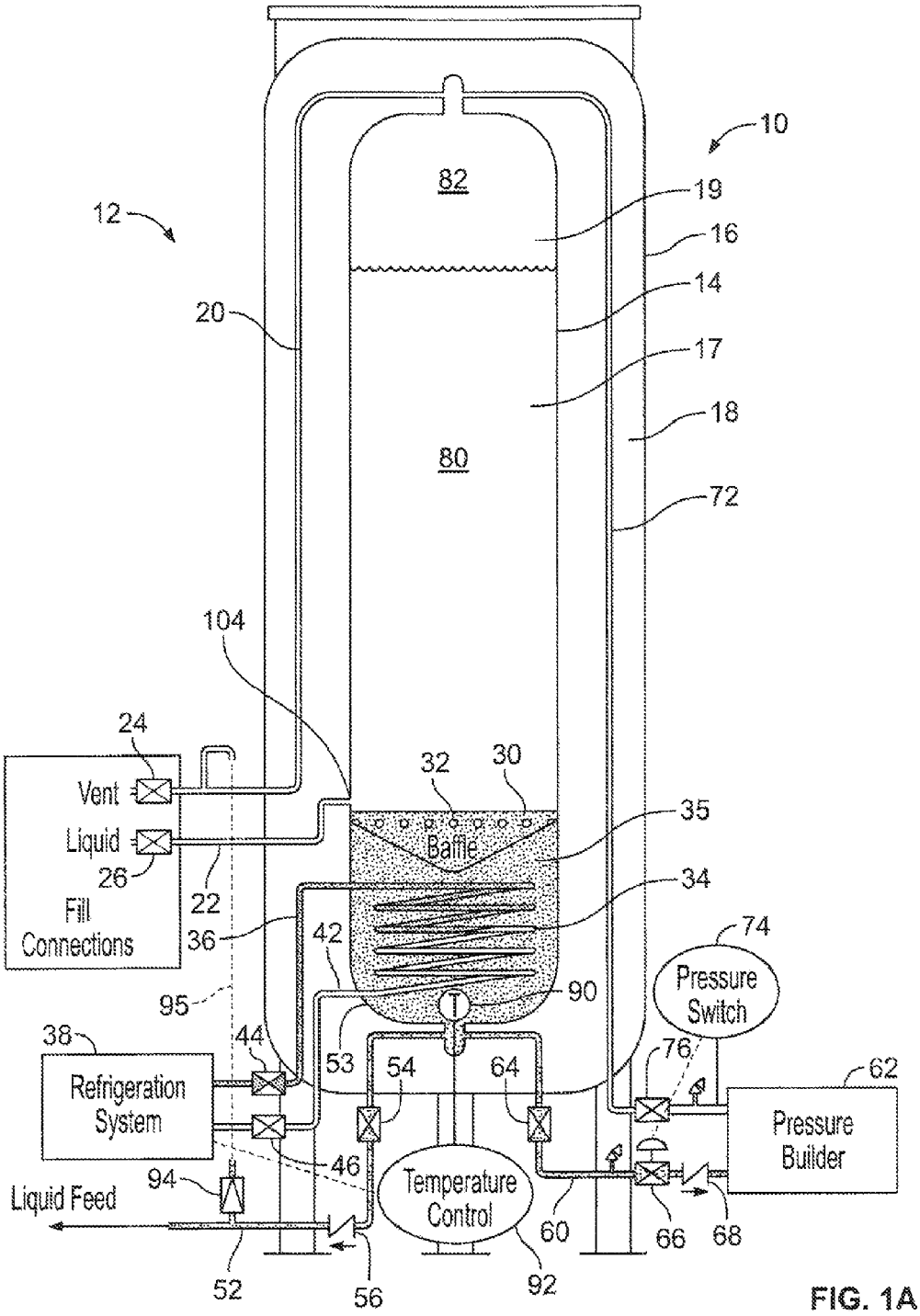
FIGS. 1A-1C are schematic views illustrating a liquid $CO_2$ tank filled, approximately half full and in need of refilling, respectively.
Figure 1B:
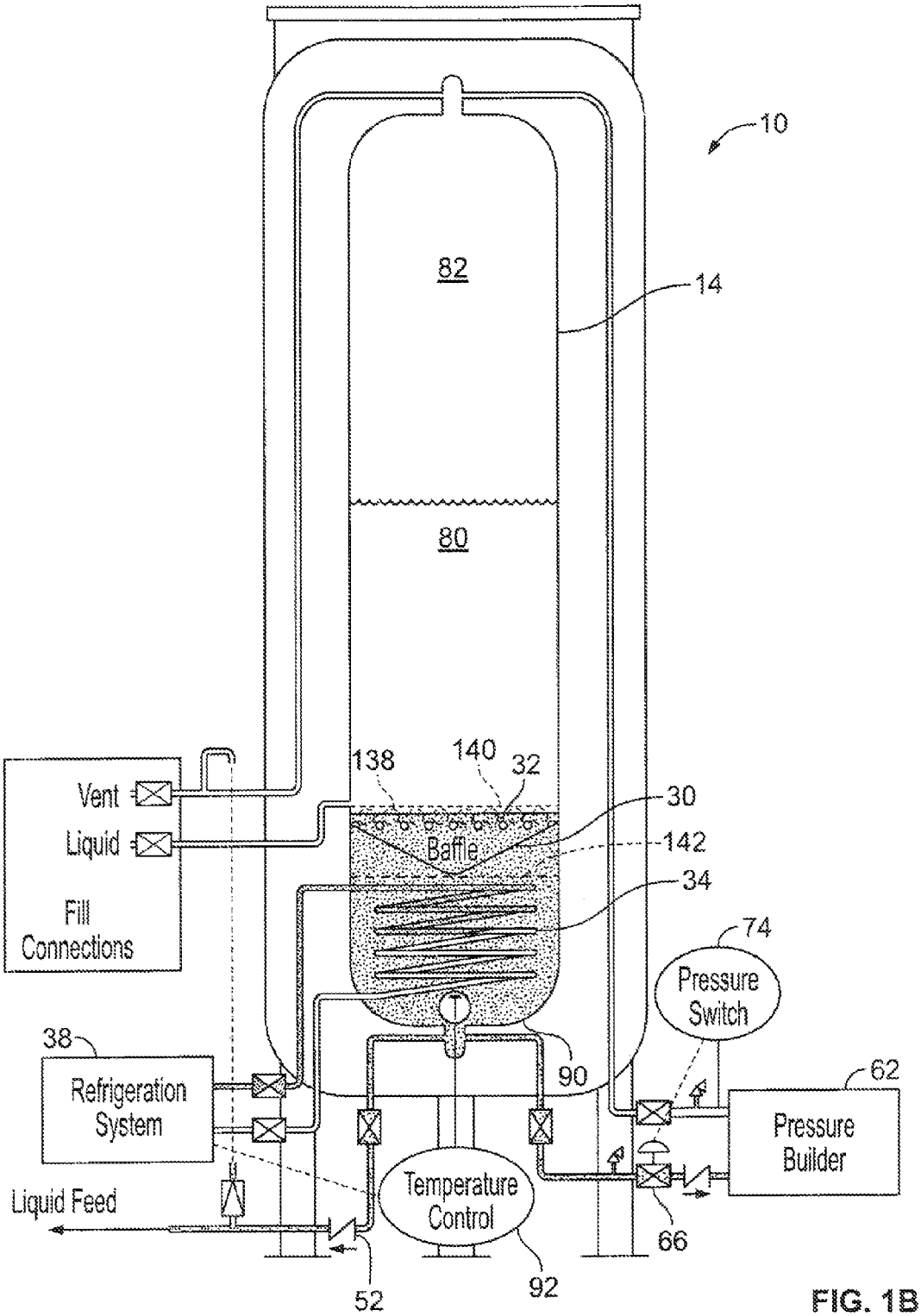
Figure 1C:
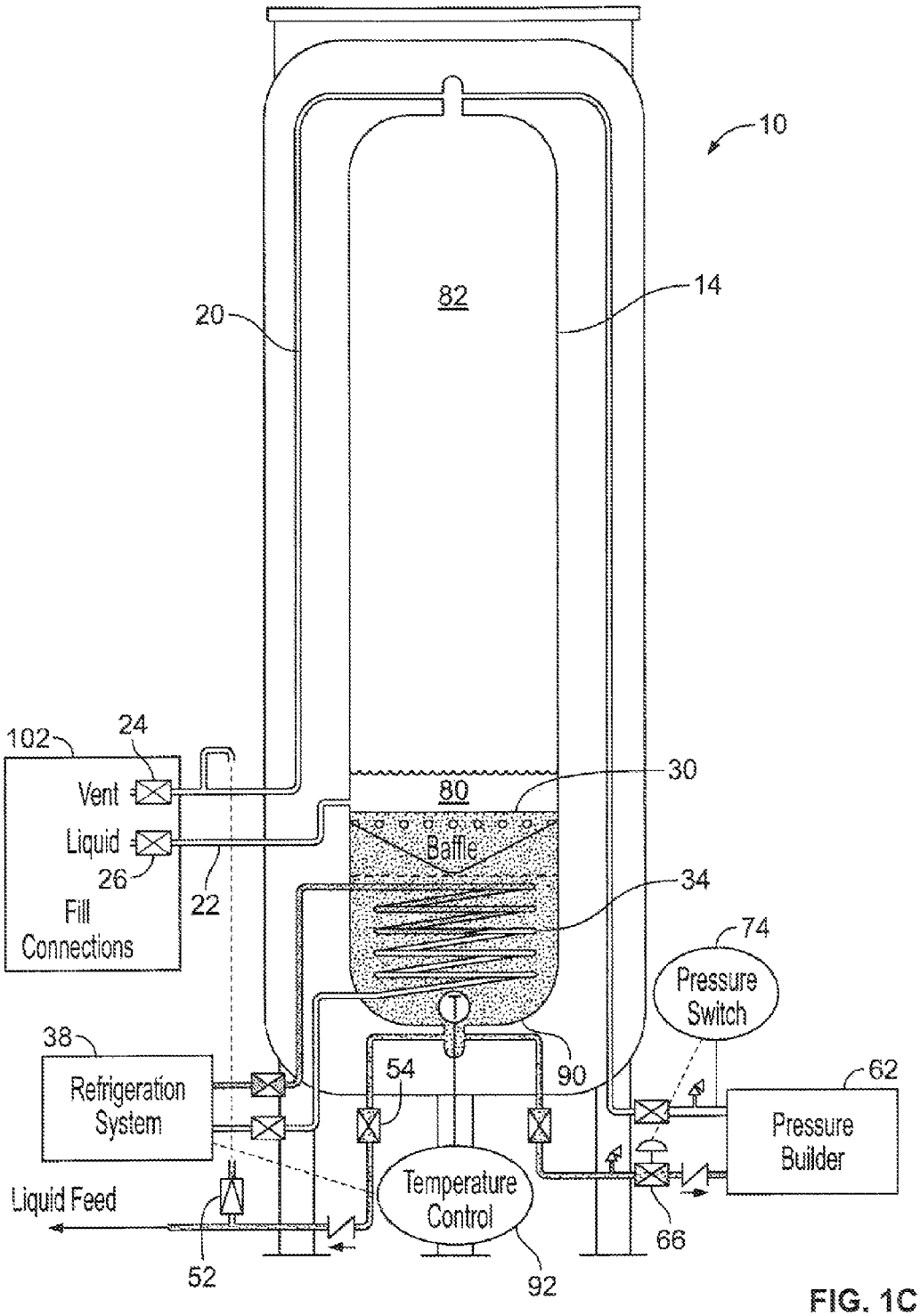

A system, indicated in general at 10 in FIGS. 1A-1C includes a bulk tank, indicated in general at 12, that includes an inner tank 14 surrounded by outer jacket 16. The tank preferably is vertically oriented, being sized so as to have a height that is greater than the width of the interior 17 of the inner tank 14. Inner tank 14 is preferably sized to hold a reservoir of liquid having a depth of at least 6 feet. The annular insulation space 18 defined between the inner tank 14 and outer jacket 16 may be vacuum-insulated and/or at least partially filled with an insulation material so that inner tank 14 is insulated from the ambient environment. As an example only, the insulation material may include multiple layers of paper and foil that are preferably combined with the vacuum insulation in the annular insulation space.

When used for food freezing and/or refrigeration processes, the inner tank 14 is preferably constructed of grade T304 stainless steel (food grade). Such an inner tank provides operating temperatures down to −320° F. at pressures of around 350 psig. Outer jacket 16 is preferably constructed of high grade carbon steel.

While the invention will be described below in terms of liquid carbon dioxide for use in food refrigeration and/or freezing processes, it should be understood that the invention may be used for other liquids useful in refrigeration and/or freezing related processes, including cryogenic liquids.

As illustrated in FIGS. 1A-1C, the inner tank 14 features a top portion 19 to which a fill vent line 20 is connected. In addition, a liquid fill line 22 is connected to a lower portion of the inner tank 14, as will be described in greater detail below. The distal end of the fill vent line 20 is provided with a fill vent valve 24 while the distal end of the liquid fill line 22 is provided with liquid fill valve 26, and both are adapted to be connected to a source of liquid, such as a tanker truck, for refilling the bulk tank. The fill vent line 20 provides a vapor balance during the refilling operation.

A baffle 30 is positioned within the lower portion of the interior tank 14. The baffle is preferably constructed of stainless steel and has a thickness of approximately 0.105 inches. The baffle features a shallow cone shape and is circumferentially secured to the interior surface of the inner tank 14. The baffle features a number of openings 32 that permit passage of liquid. The functionality of the baffle will be explained below.

An internal heat exchanger coil 34 is positioned in the bottom portion 35 of the tank and is connected by coil inlet line 36 to a refrigeration system 38. A coil outlet line 42 joins the internal heat exchanger coil 34 to the refrigeration system 38 as well. Coil inlet line 36 optionally includes a coil inlet valve 44 while coil outlet line 42 optionally includes a coil outlet valve 46.

Figure 5:
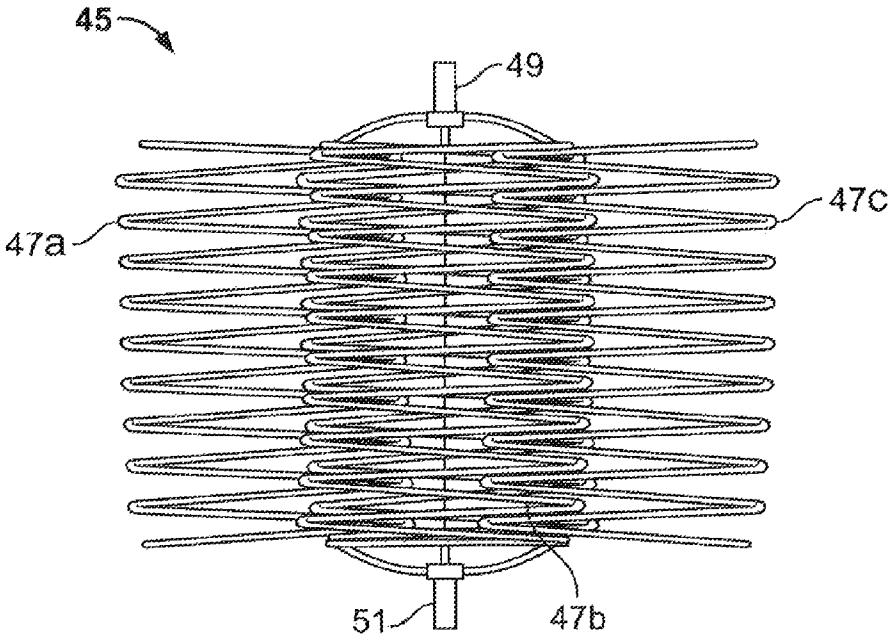
FIG. 5 is a side elevational view of the heat exchanger coil of FIG. 4.
Figure 4:
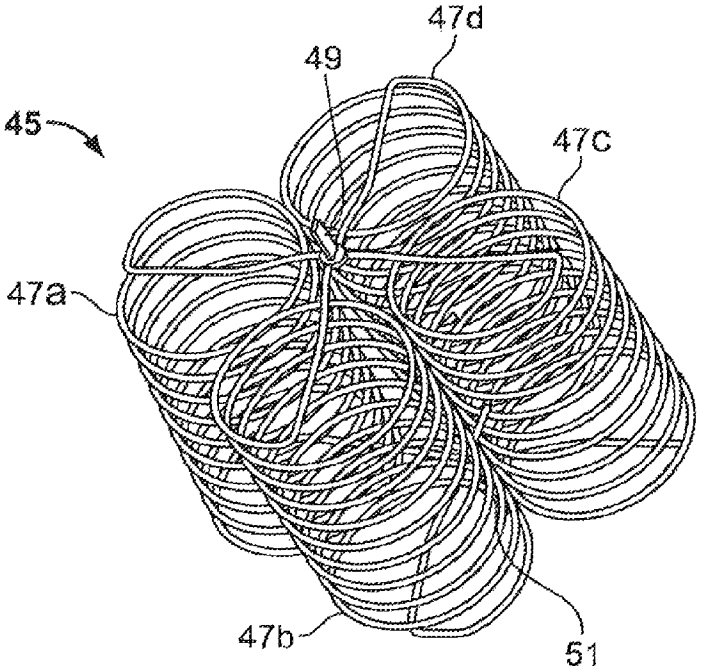
FIG. 4 is a perspective view showing an alternative embodiment of the heat exchanger coil of the system and method of FIGS. 1A-1C.

While a single coil heat exchanger is indicated at 34 in FIGS. 1A-1C, the heat exchanger could alternatively feature a number of coils, connected either in series or in parallel or both. For example, an alternative embodiment of the heat exchanger coil 34 is indicated in general at 45 in FIGS. 4 and 5. As indicated in FIGS. 4 and 5, the heat exchanger 45 includes four coils 47*a*, 47*b*, 47*c* and 47*d* connected in parallel with an inlet 49 and an outlet 51. Alternatively, coils 47*a*-47*d* could be connected in series. As another example, the heat exchanger coil may include two or more concentric coils connected in parallel or in series.

A liquid dispensing or feed line 52 exits the bottom 53 of the inner tank 14 and is provided with liquid feed valve 54 and liquid feed check valve 56.

A pressure builder inlet line 60 also exits the bottom portion of the inner tank 14 and connects to the inlet of pressure builder 62. The pressure builder inlet line 60 is provided with a pressure builder inlet isolation valve 64, and automated pressure builder valve 66 and a pressure builder check valve 68. A pressure builder outlet line 72 exits that pressure builder 62 and travels to the top of the inner tank 14 (vapor space 19). The pressure builder outlet line 72 is provided with a pressure switch 74 and a pressure builder outlet valve 76. As will be explained in greater detail below, the pressure switch 74 is connected to the automated pressure builder valve 66.

In operation, with reference to FIG. 1A, after the tank 12 has been filled, the inner tank 14 contains a supply of liquid $CO_2$ 80 with a headspace 82 defined above. Fill valves 24 and 26, feed valve 54 and automated pressure builder valve 66 are closed, while coil inlet and outlet valves 44 and 46 and pressure builder inlet and outlet valves 64 and 76 are open. While the description below assumes that the feed valve 54 is closed, it may be open in alternative modes of operation, also described below. As an example only, the refill transport provides the liquid $CO_2$ at a pressure of approximately 270 psig and a temperature of approximately −10° F.

The pressure switch 74 senses the pressure in headspace 82 via pressure builder outline line 72. If the pressure is below the target pressure of 300 psig, the pressure switch 74 opens automated pressure builder valve 66 so that liquid $CO_2$ flows to the pressure builder 62. The liquid $CO_2$ is vaporized in the pressure builder and the resulting gas travels through line 72 to the headspace 82 so that the pressure in inner tank 14 is increased. Pressure builder check valve 68 prevents burp backs through the pressure builder inlet line 60 and into the bottom of the tank that could cause undesirable mixing between the liquid $CO_2$ below the baffle and the remaining liquid $CO_2$ above the baffle. Pressure building continues until pressure switch 74 detects the target pressure of 300 psig in the inner tank 14. When the pressure switch detects the pressure of 300 psig, it will close the automated pressure builder valve 66 so that pressure building is discontinued. At this pressure, the liquid $CO_2$ 80 will have an equilibrium temperature of approximately 0° F.

The bottom portion of the tank is provided with a temperature sensor 90, such as a thermocouple, that communicates electronically with a temperature controller 92. Sensor 90 can alternatively be a pressure sensor or a saturation bulb. The temperature controller 92 controls operation of the refrigeration system 38 and may be a microprocessor or any other electronic control device known in the art. When the temperature controller detects, via the temperature sensor, a temperature that is higher than the desired or target temperature, it activates the refrigeration system 38. Continuing with the present example, the temperature sensor detects the 0° F. temperature of the liquid $CO_2$ in the inner tank and activates the refrigeration system 38. A refrigerant fluid in liquid form then travels through line 36 to the internal heat exchanger coil 34 and is vaporized so as to subcool the liquid $CO_2$ in the bottom portion of inner tank 14. The vaporized refrigerant fluid travels back to the refrigeration system 38 via line 46 for regeneration. More specifically, the refrigeration system 38 includes a condenser for re-liquefying the refrigerant fluid. As an example only, the refrigerant fluid is preferably R-404A/R-507.

The refrigeration system and internal heat exchanger coil continue to subcool the liquid $CO_2$ in the bottom portion of the inner tank until the target temperature, −40° F. for example, is reached. The temperature controller 92 senses that the target temperature has been reached, via the temperature sensor 90, and shuts down the refrigeration system 38.

Due to stratification in the inner tank and the baffle 30, even though the liquid $CO_2$ below the baffle has been subcooled, the pressure remains at 300 psig for pushing the liquid $CO_2$ from the tank during dispensing. The headspace 82 preferably operates at 300 psig to allow direct replacement of older systems so as not to alter the food freezing equipment set up for 300 psig. More specifically, stratification occurs throughout the liquid $CO_2$ 80 between the $CO_2$ gas in the headspace 82 of the inner tank and the subcooled liquid $CO_2$ in the bottom portion of the tank. The baffle assists in the stratification by creating a cold zone in the bottom of the tank that is mostly insulated from the remaining liquid $CO_2$ above the baffle. This improves the efficiency of the internal heat exchanger coil in subcooling the liquid beneath the baffle and inhibits migration of the subcooled liquid into the warmer liquid above the baffle. As a result, the tank holds an inventory of high pressure equilibrium liquid $CO_2$ in the region above the baffle, similar to that available from a conventional high pressure storage vessel, and an inventory of high pressure, subcooled liquid $CO_2$ in the region or zone below the baffle.

As an example only, for a tank having an inner tank height of 29 feet, and an inner tank width of 8 feet, the baffle 30 would ideally be positioned 7 feet from the bottom of the tank. In general, the baffle 30 is preferably positioned approximately 24% of the total height of the inner tank from the bottom of the inner tank or at a level where approximately 30% of the tank volume is below the baffle.

When the tank target pressure and target subcooled liquid temperature have been reached, the liquid feed valve 54 may be opened so that the subcooled liquid $CO_2$ may be dispensed through feed line 52 and expanded at atmospheric pressure to make snow or otherwise used for a food freezing or refrigeration process. In an alternative mode of operation, the liquid feed valve 54 may be left open during filling for operation of the system during filling or prior to full refrigeration at a reduced efficiency. Check valve 56 prevents burp backs through the feed line 52 and into the bottom of the tank that could cause undesirable mixing between the subcooled liquid $CO_2$ and the remaining liquid $CO_2$ above the baffle.

As illustrated in FIG. 1A, the liquid feed line 52 is provided with a pressure relief check valve 94 that communicates with fill vent line 20 via liquid feed vent line 95. In the event that the pressure within the feed line 52 rises above a predetermined level, the pressure relief valve 94 automatically opens so that pressure is vented through line 20.

As illustrated in FIG. 1B, the level of the liquid $CO_2$ 80 drops as liquid $CO_2$ is dispensed through feed line 52. As this occurs, liquid $CO_2$ travels from the region above the baffle 30, through the openings 32 of the baffle, and into the zone below the baffle. Temperature sensor 90 constantly monitors the temperature of the liquid $CO_2$ in the zone below baffle 32 and pressure switch 74 constantly monitors the pressure within the head space 82 above the liquid $CO_2$. The pressure switch opens the automated pressure building valve 66 as is necessary to maintain and hold the tank operating pressure at approximately 300 psig via the pressure builder 62. Temperature sensor 90 and temperature controller 92 similarly activate refrigeration system 38 as is necessary to maintain the temperature of the liquid $CO_2$ in the zone below the baffle at approximately −40° F. via the internal heat exchanger coil 34.

It should be noted that alternative automated control arrangements known in the art may be substituted for the temperature sensor and controller 90 and 92 and/or the pressure switch and automated pressure building valve 74 and 66. For example, in an alternative embodiment of the system, a single system programmable logic controller (PLC) is connected to a pressure sensor in the head space 82 of the tank and the temperature sensor 90 so as to control operation of the refrigeration system 38 and the pressure builder 62.

With reference to FIG. 1C, when the level of liquid CO2 reaches 25% above the baffle 30, dispensing of liquid CO2 through feed line 52 may be halted by closing feed valve 54. Typically the feed valve 54 is left open during the filling process. Level alarms can signal for refill or trigger alarms for low level.

It should be noted that liquid may be dispensed to levels lower than 25% above the baffle, but the heat exchanger coil 34 may become less efficient as the liquid level drops lower than the coil.

A tanker truck, or other liquid $CO_2$ delivery source, is connected to the fill vent line 20 and the liquid fill line 22 via fill connections 102. Fill vent valve 24 and liquid fill valve 26 are opened so that the inner tank 14 is refilled with liquid $CO_2$.

As an alternative to shutting feed valve 54, when the level of liquid $CO_2$ in the tank reaches the level 20% above the baffle, 32, the tanker truck, or other $CO_2$ liquid delivery source, may be connected to fill connections 102, and the dispensing of liquid $CO_2$ may continue uninterrupted. The pressure builder 62 and refrigeration system 38 and coil 34 operate under the direction of the pressure switch 74 and automated pressure building valve 66 and the temperature sensor 90 and temperature controller 92 as described above to maintain the approximate 300 psig pressure and −40° F. temperature (below baffle 30) within inner tank 14. As a result, the system permits the delivery of subcooled liquid $CO_2$ to continue uninterrupted.

As noted previously, the baffle 30 helps separate the liquid underneath the baffle from the liquid above so that the liquid below is not disturbed. This increases the efficiency in creating and maintaining the subcooled state of the liquid $CO_2$ below the baffle. Positioning the fill line opening 104 of the liquid fill line 22 above the baffle helps prevent the incoming liquid $CO_2$ from disturbing the subcooled liquid $CO_2$ under the baffle, which further aids in increasing efficiency in creating and maintaining the subcooled state of the liquid $CO_2$ below the baffle.

An example of a suitable pressure builder 62 is the sidearm $CO_2$ vaporizer available from Thermax Inc. of South Dartmouth, Mass. An example of a suitable refrigeration system 38 is the Climate Control model no. CCU1030ABEX6D2 condensing unit available from Heatcraft Refrigeration Products, LLC of Stone Mountain, Ga.

Figure 2:
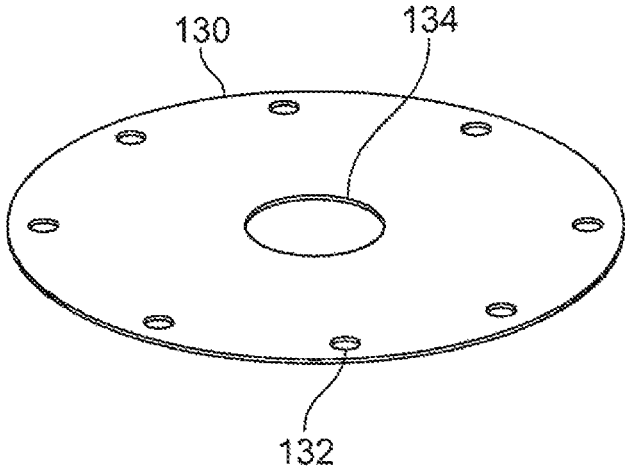
FIG. 2 is a perspective view of an alternative embodiment of the baffle of the system of the present invention.

While the baffle of FIGS. 1A-1C is shown to be cone shaped, the baffle alternatively could be provided with a disk shape, as illustrated at 130 in FIG. 2. The baffle 130 is also preferably constructed from stainless steel that is approximately 0.105 inches thick and includes openings 132 and 134 to permit liquid $CO_2$ to travel from the upper region of inner tank 114 to the zone or region below the baffle.

As yet another alternative embodiment of the baffle, the baffle takes the form of a plurality of glass or STYROFOAM insulation beads, indicated in phantom at 138 in FIG. 1B, that float between upper and lower screens 140 and 142, respectively. The screens may be mounted to ring-like frames that are circumferentially attached to the interior surface of inner tank 13. The bead material is chosen so that the beads have a density which allows them to float on the denser subcooled liquid $CO_2$ up to the level of upper screen 140. The beads are large enough in both size and number that the cross section of the inner tank 14 is generally covered. As a result, the beads form a floating baffle arrangement that creates an insulation layer between the subcooled liquid $CO_2$ below and the remaining liquid $CO_2$ above. In this regard, reference is made to U.S. Pat. No. RE35,874, the contents of which are hereby incorporated by reference.

Figure 3:
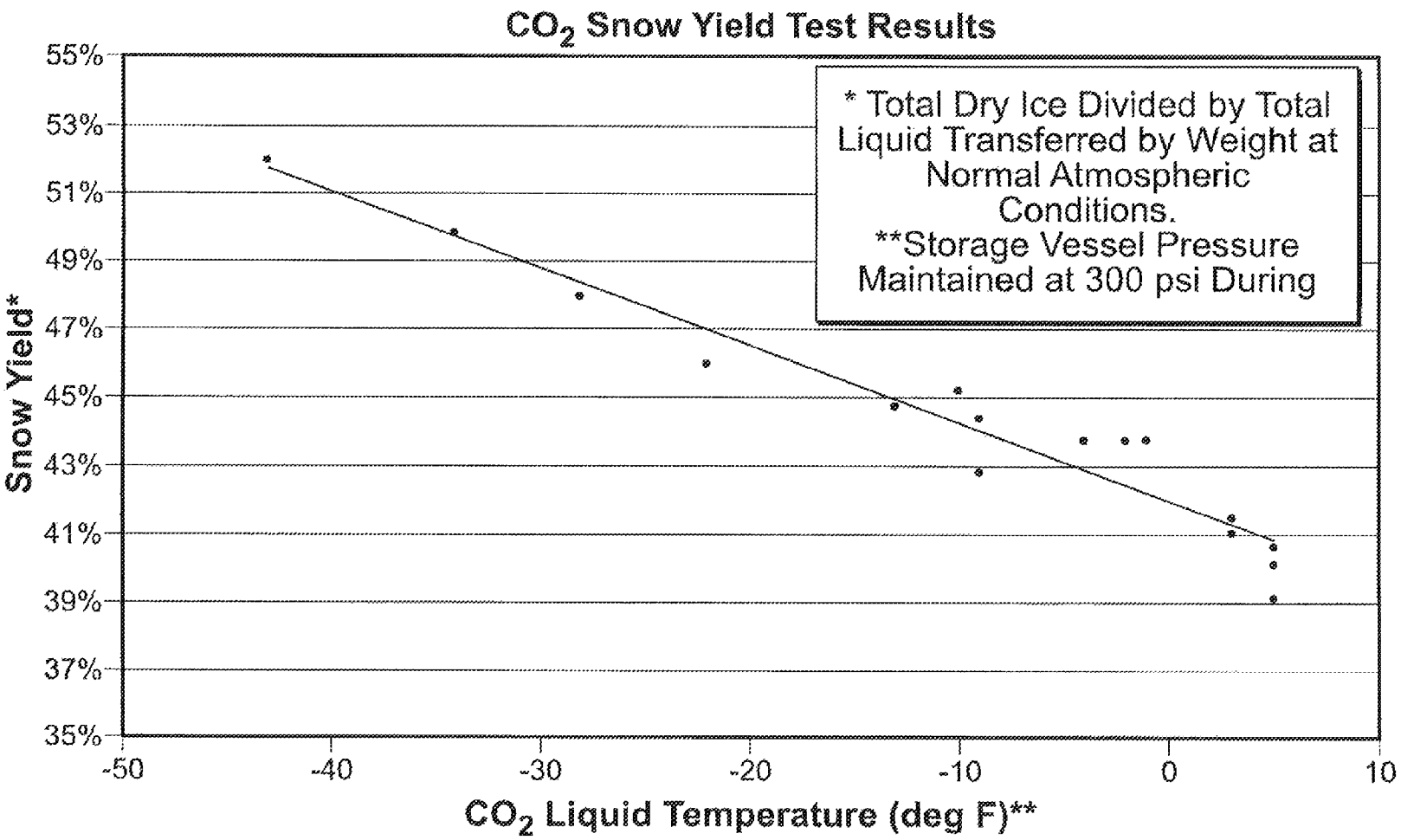
FIG. 3 is a graph illustrating improvements in snow yield v. temperature possible with the system of FIGS. 1A-1C.

By dispensing subcooled liquid $CO_2$, the present invention improves snow yield when the liquid is expanded to ambient pressure, as illustrated in FIG. 3. More specifically, by subcooling the liquid $CO_2$ in the region or zone below the baffle, the snow yield rises from slightly over 42% for liquid $CO_2$ at equilibrium temperature for 0° F. to over 52% at equilibrium temperature for −43° F. This equates to an increase in refrigeration capacity of the subcooled liquid $CO_2$, which permits faster food throughput in food freezing operations. An example of suitable snow making equipment (snowhorn), which was used to create the data of FIG. 3, is available from Gray Tech Carbonic, Inc.

The increase in snow yield and refrigeration capacity of the above system results in less carbon dioxide consumption. As a result, there is less $CO_2$ gas delivered to the environment, which makes the system and method of the invention a "green" technology. In addition, the baffle of the system increases the efficiency of the refrigeration system in subcooling the liquid $CO_2$ below the baffle. This permits smaller, and thus more efficient, compressors to be used in the refrigeration system.

Figure 6:
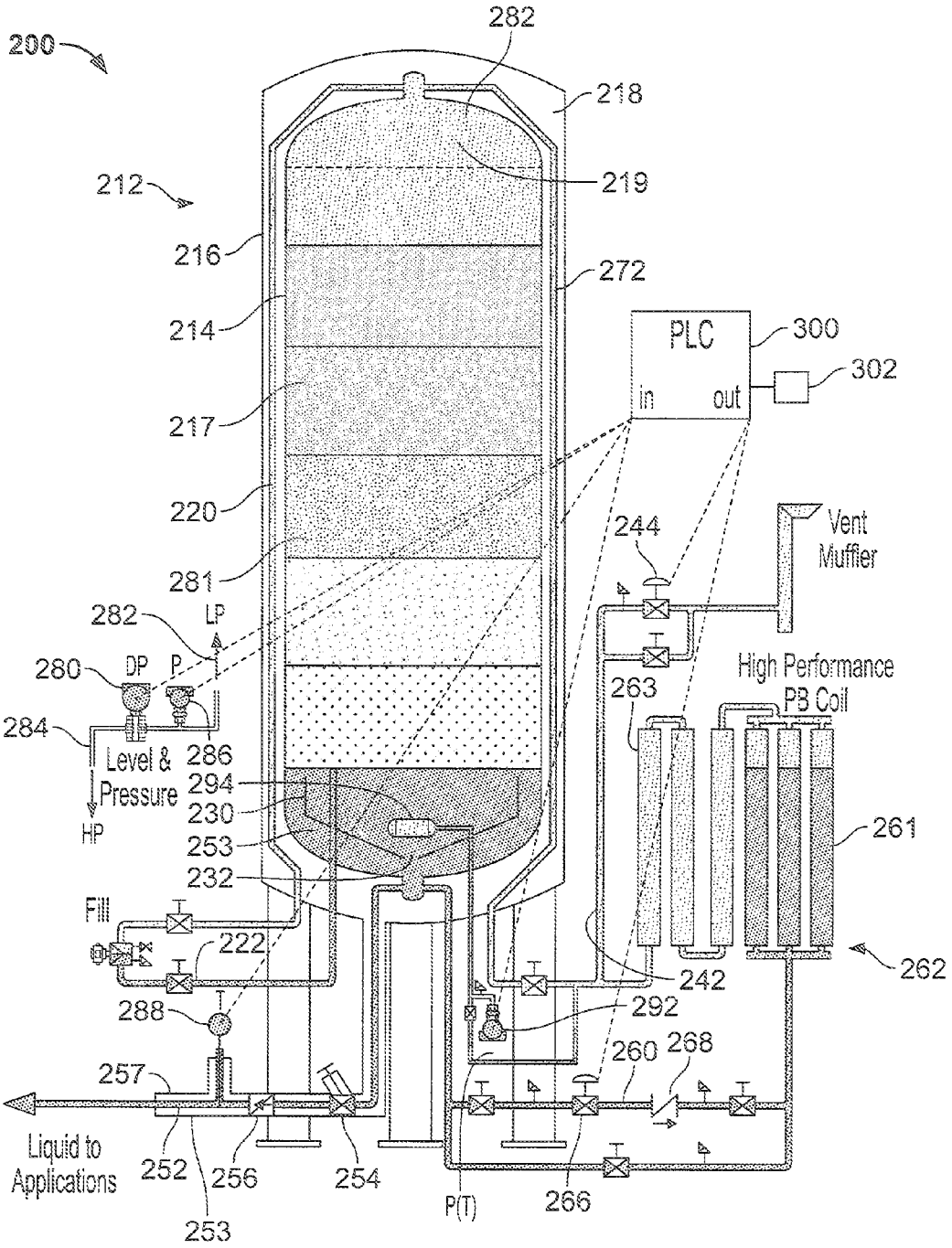
FIG. 6 is a schematic view illustrating an embodiment of the system of the invention.

An embodiment of the system of the invention is indicated in general at 200 in FIG. 6. Similar to the system 10 of FIGS. 1A-1C, the system 200 includes a bulk tank, indicated in general at 212, that includes an inner tank 214 surrounded by outer jacket 216. The tank preferably is vertically oriented, being sized so as to have a height that is greater than the width of the interior 217 of the inner tank 214. The annular insulation space 218 defined between the inner tank 214 and outer jacket 216 may be vacuum-insulated and/or at least partially filled with an insulation material so that inner tank 214 is insulated from the ambient environment. As an example only, the insulation material may include multiple layers of paper and foil that are preferably combined with the vacuum insulation in the annular insulation space.

As an example only, bulk tank 212 may range in size from 11,000 gallons to 16,000 gallons and may have a pressure capacity of 175 psig. Examples of tank size include 114 inches in diameter with a height ranging from 450 inches to 600 inches. When used for food freezing and/or refrigeration processes, the inner tank 214 is preferably constructed of grade T304 stainless steel (food grade). Outer jacket 216 is preferably constructed of high grade carbon steel.

While the invention will be described below in terms of liquid nitrogen, it should be understood that the invention may be used for other cryogenic liquids useful in refrigeration and/or freezing related processes, such as industrial, medical or food processing.

As illustrated in FIG. 6, the inner tank 214 features a top portion 219 to which a fill vent line 220 is connected. In addition, a liquid fill line 220 is connected to a lower portion of the inner tank 214. The distal end of the fill vent line 220 is provided with a fill vent valve while the distal end of the liquid fill line 22 is provided with liquid fill valve, and both are adapted to be connected to a source of liquid, such as a tanker truck, for refilling the bulk tank. The fill vent line 220 provides a vapor balance during the refilling operation.

A liquid dispensing or feed line 252 exits the bottom 253 of the inner tank 214 and is provided with liquid feed valve 254 and liquid feed check valve 256. The dispensing line is also provided with vacuum insulation 257. The dispensing line 252 is constructed to attach directly to a vacuum jacketed house line for delivery of the cryogenic liquid inside the plant.

A pressure builder inlet line 260 also exits the bottom portion of the inner tank 214 and connects to the inlet of a high performance pressure builder, indicated in general at 262. As illustrated in FIG. 6, a first stage of the pressure builder features a number of parallel heat exchangers 261. The outlet of the first stage of the pressure builder communicates with the inlet of a second stage of the pressure builder 262 which includes a number of series heat exchangers 263. As an example only, the high performance pressure builder may take the form of the pressure building system disclosed in commonly owned U.S. Pat. No. 6,799,429, the contents of which are hereby incorporated by reference.

The first stage of the pressure builder 262 preferably supports withdrawal rates up to 20 GPM while the second stage of the pressure builder preferably supports demands up to 40 GPM. To support these flow rates, the dispensing line 252 preferably is either 1½" or 2" in diameter.

The pressure builder inlet line 260 is provided with an automated pressure builder valve 266 and a pressure builder check valve 268. A pressure builder outlet line 272 exits pressure builder 262 and travels to the top of the inner tank 214. The pressure builder outlet line is provided with a vent line 242 which includes an automated vent valve 244.

With reference to FIG. 6, after the tank 212 has been filled, the inner tank 214 contains a supply of liquid nitrogen 281 with a headspace 282 defined above.

To promote stable liquid withdrawal during a product refill, the system incorporates a low-mounted internal horizontal baffle 230 with a side wall bottom fill designed to direct the incoming liquid up the side of the vessel during bottom filling. The baffle is circumferentially secured to the interior surface of the inner tank 214 by spaced braces. In addition to the spaces between the baffle braces, the baffle features a central opening 232 that permits passage of liquid. The primary function of the baffle is to aid in deflecting unwanted heat from the vessel bottom supports and piping penetrations up the sides of the tank to promote liquid stratification, which keeps the liquid colder at the tank bottom to feed the application.

As illustrated in FIG. 6, the system 200 includes a liquid level sensor preferably in the form of a differential pressure gauge 280, which communicates with the head space of the tank interior via low phase line 282 and the bottom of the tank interior via high phase line 284. In addition, a vapor pressure sensor 286 communicates with the headspace of the tank via low phase line 282.

In addition, the dispensing line 252 is provided with a liquid outlet temperature sensor 288 while the bottom of the tank interior is provided with a tank liquid temperature sensor that is preferably a saturation pressure sensor 292 that communicates with a pressure bulb 294. The pressure bulb 294 is a capped pipe inside the bottom of the tank surrounded by liquid. Inside the pipe is gaseous nitrogen. The liquid cools the pipe and condenses the gas inside. The pressure inside the pipe is the saturation pressure of the liquid. The pressure sensor 292 is in communication with the interior of the pipe. As will be explained below, the tank liquid temperature may be calculated from the saturation pressure detected by the pressure sensor 292.

Liquid level gauge 280, vapor pressure sensor 286, liquid outlet temperature sensor 288 and saturation pressure sensor 292 each communicate with a controller, such as programmable logic controller ("PLC") 300 in FIG. 6. The PLC also communicates with, and controls operation of, automated pressure building valve 266 and automated vent valve 244. An example of a suitable PLC is the Allen-Bradley MicroLogix 830 available from Rockwell Automation, Inc. of Milwaukee, Wis. It should be noted that devices other than a PLC, including, but not limited to, pressure switches, may be used as the controller 300.

The PLC performs with the system 200 as a dynamic pressure builder to maintain a constant pressure for the liquid nitrogen flowing through dispensing line 252 by varying the vapor pressure in the tank via the pressure building valve 266 and the vent valve 244. The PLC takes sensor inputs for the liquid level (from differential pressure gauge 280), tank vapor pressure (from vapor pressure sensor 286), and tank temperature (from saturation pressure sensor 292) to calculate when to operate the pressure builder. In addition, the PLC calculates the necessary vapor pressure in order to deliver saturated liquid at the usage point using the liquid outlet temperature detected by sensor 288, in combination with the other data inputs noted above.

With regard to tank temperature, the PLC calculates the tank liquid temperature using the saturation pressure from saturation pressure sensor 292.

The PLC uses the tank liquid temperature and level of the liquid as well as the pressure of the vapor to calculate the pressure at the bottom of the tank (vapor pressure+liquid head=pressure at the bottom of the tank).

Using the liquid outlet temperature detected by sensor 288 in the liquid dispensing line, the PLC 300 determines the required saturation pressure at the outlet and compares it with the pressure at the bottom of the tank calculated above. If the pressure at the bottom of the tank is too low (lower than the required outlet saturation pressure), the PLC will automatically open pressure building valve 266 so that the pressure builder 262 receives liquid from the bottom of the tank and vaporizes it. The vapor travels to the top of the tank via line 272 so as to pressurize it. As described above, stratification of the liquid in the tank and the baffle 230 help isolate the liquid at the bottom of the tank from temperature increases. Conversely, if the pressure at the bottom of the tank is too high (higher than the required outlet saturation pressure), the PLC 300 will open the vent valve 244 to vent vapor from the tank headspace through lines 272 and 242 to the atmosphere to lower the pressure in the tank.

In view of the above, the PLC 300 enables the customer to set their requirements using input device 302 (which may be, for example, a computer keyboard or control panel) with very tight parameters (such as +/−2 psi) to operate these two valves. For example, in a typical food freezing application, the pressure builder can be set to 25 psig and the vent at 35 psig. These pressure set points are at the bottom of the tank, not at the traditional top vapor space. Not only is the band tighter in comparison to traditional regulators, but the system precisely controls the outlet pressure regardless of the tank liquid level.

Figure 7:
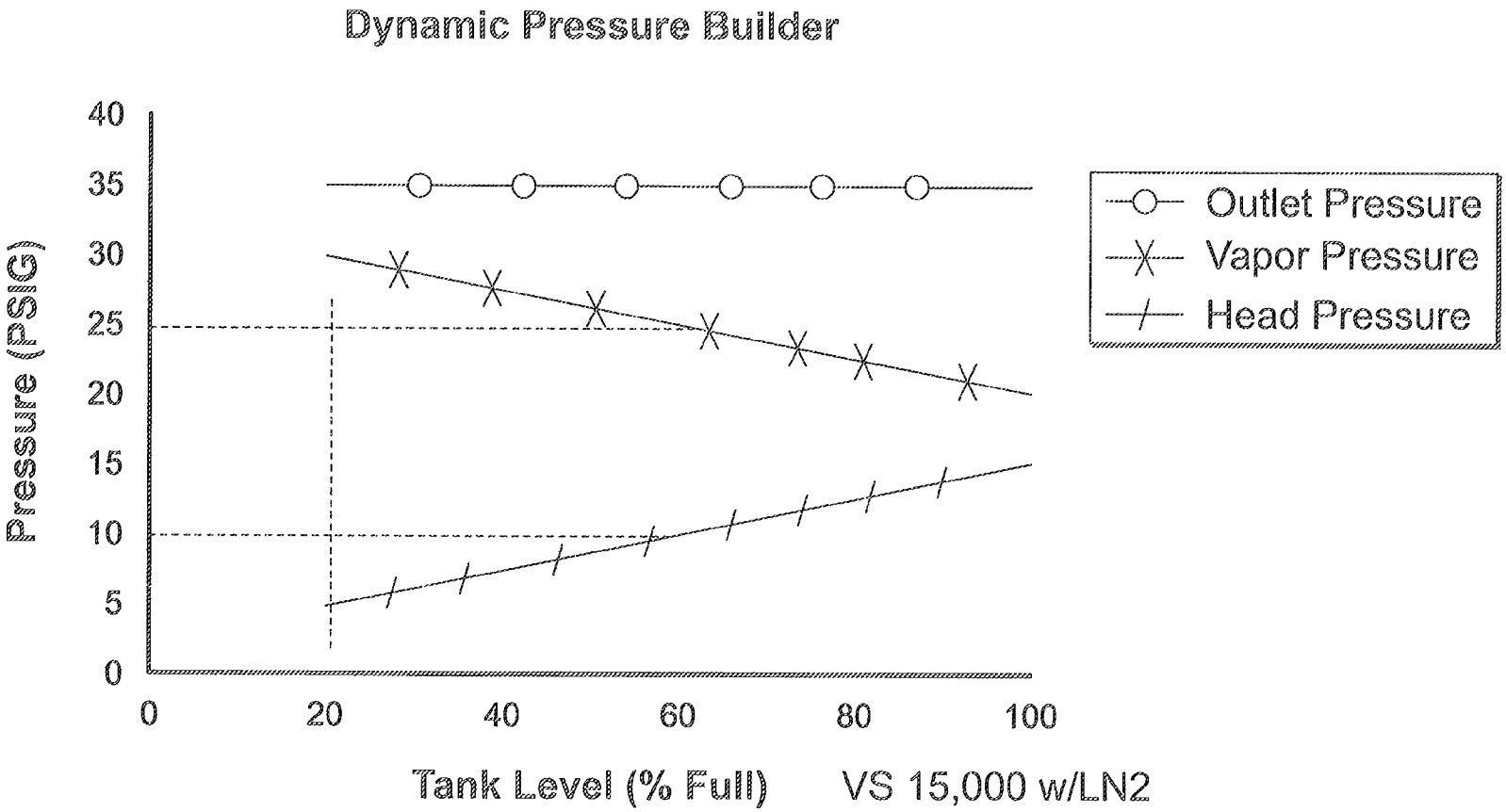
FIG. 7 is a graph illustrating how the outlet pressure of the system of FIG. 6 stays generally constant in accordance with an embodiment of the method of the invention.

As illustrated in FIG. 7, the PLC program makes real-time adjustments so as the liquid level falls in normal use, the set point to turn on the pressure builder valve increases to compensate for the loss in liquid head pressure. The result is a generally consistent outlet pressure through the dispensing line 252 to the application regardless of tank liquid level.

Figure 8:
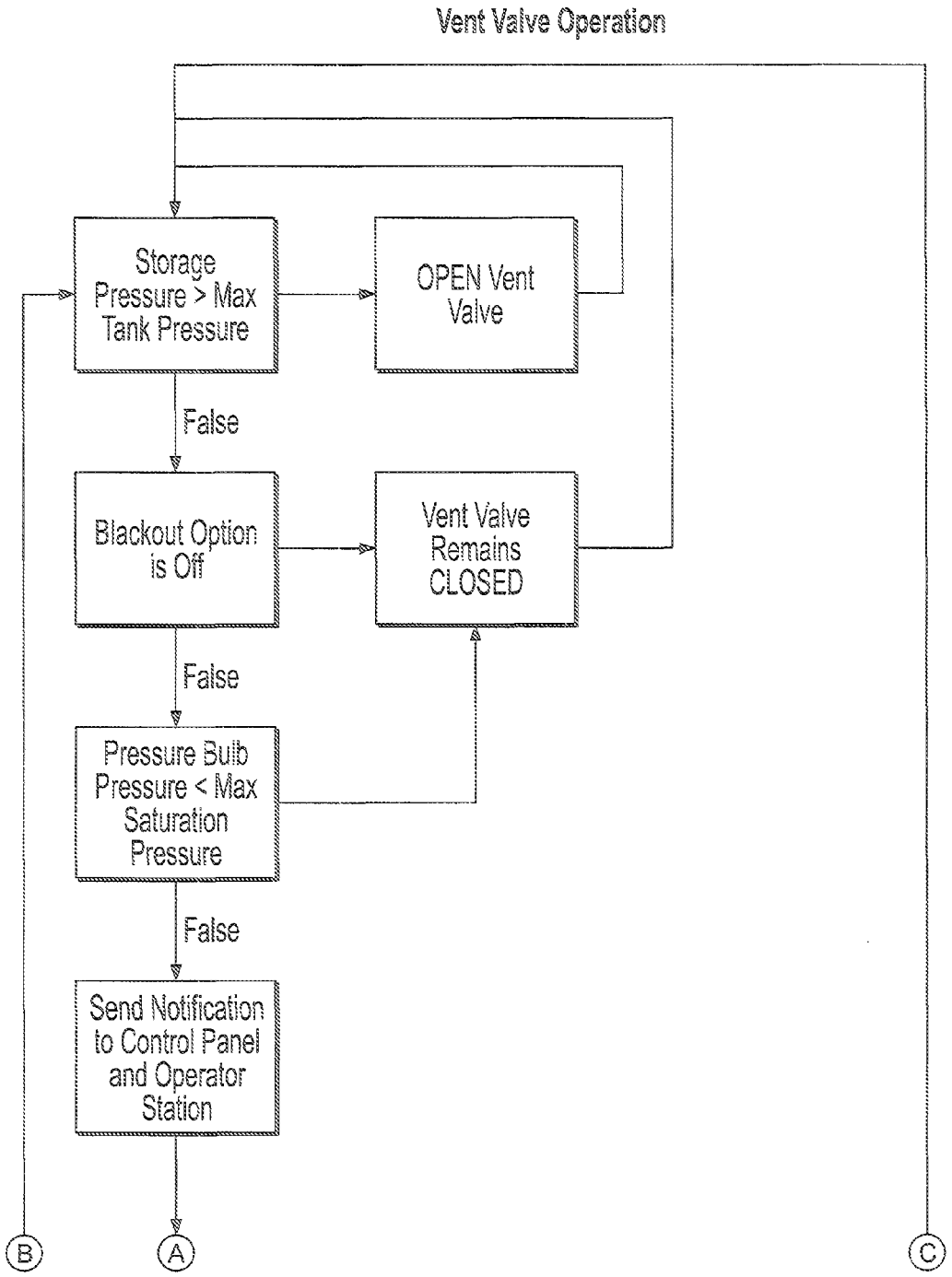
FIG. 8 is a flow chart illustrating the processing performed by the programmable logic controller of the system of FIG. 6 in controlling the vent valve in accordance with an embodiment of the system and method of the invention.
Figure 8:
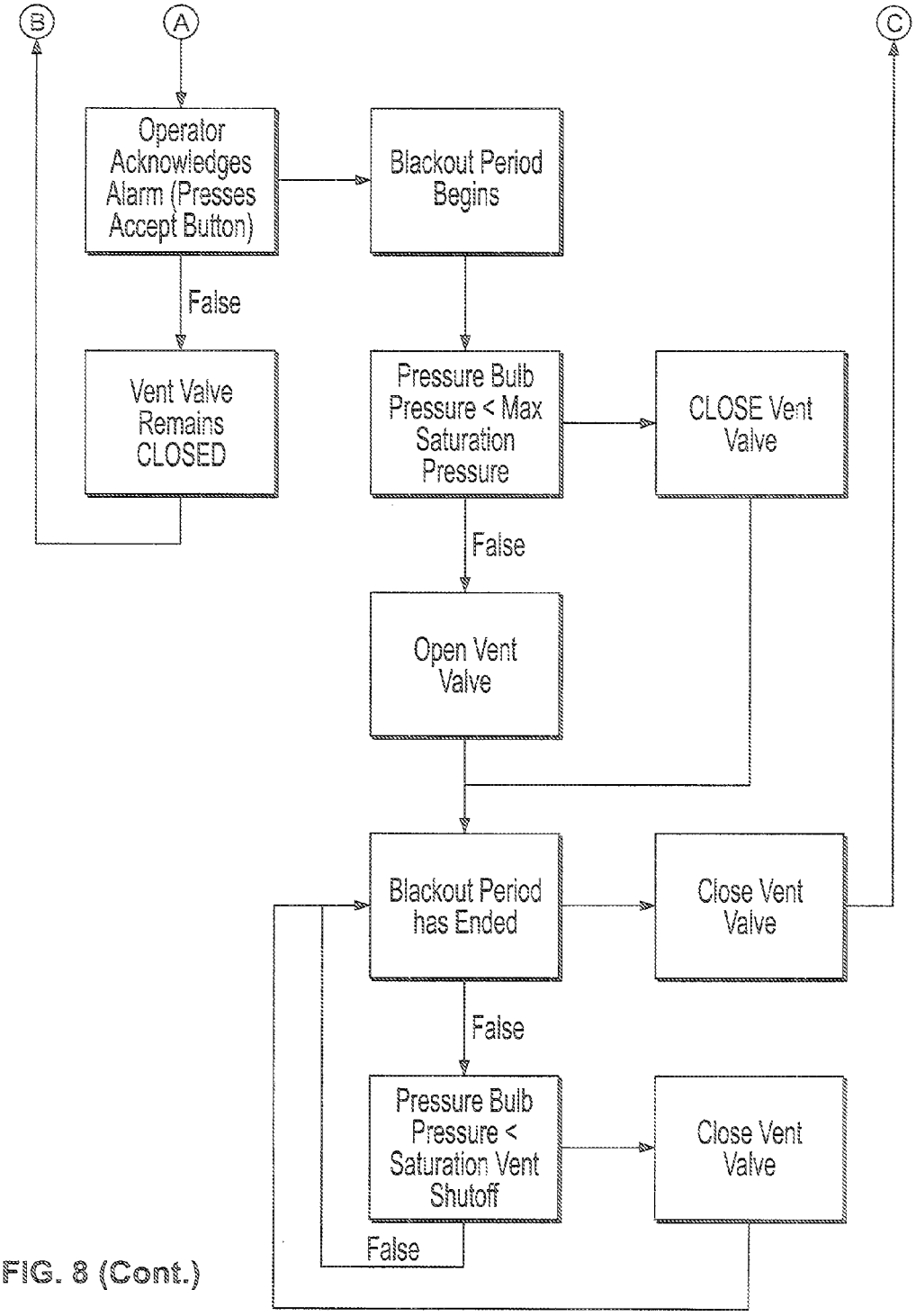
Figure 9:
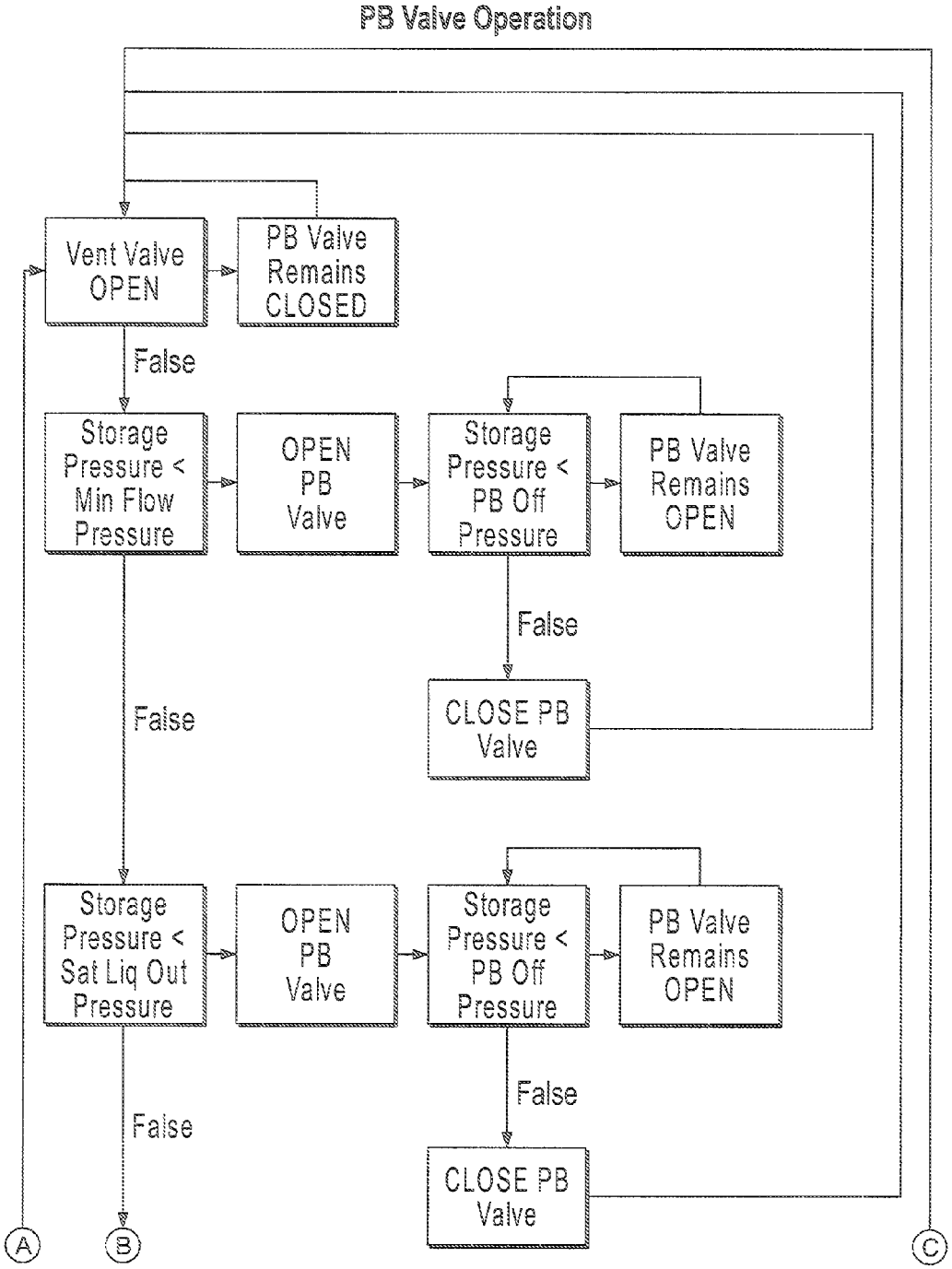
FIG. 9 is a flow chart illustrating the processing performed by the programmable logic controller of the system of FIG. 6 in controlling the pressure building valve in accordance with an embodiment of the system and method of the invention.
Figure 9:
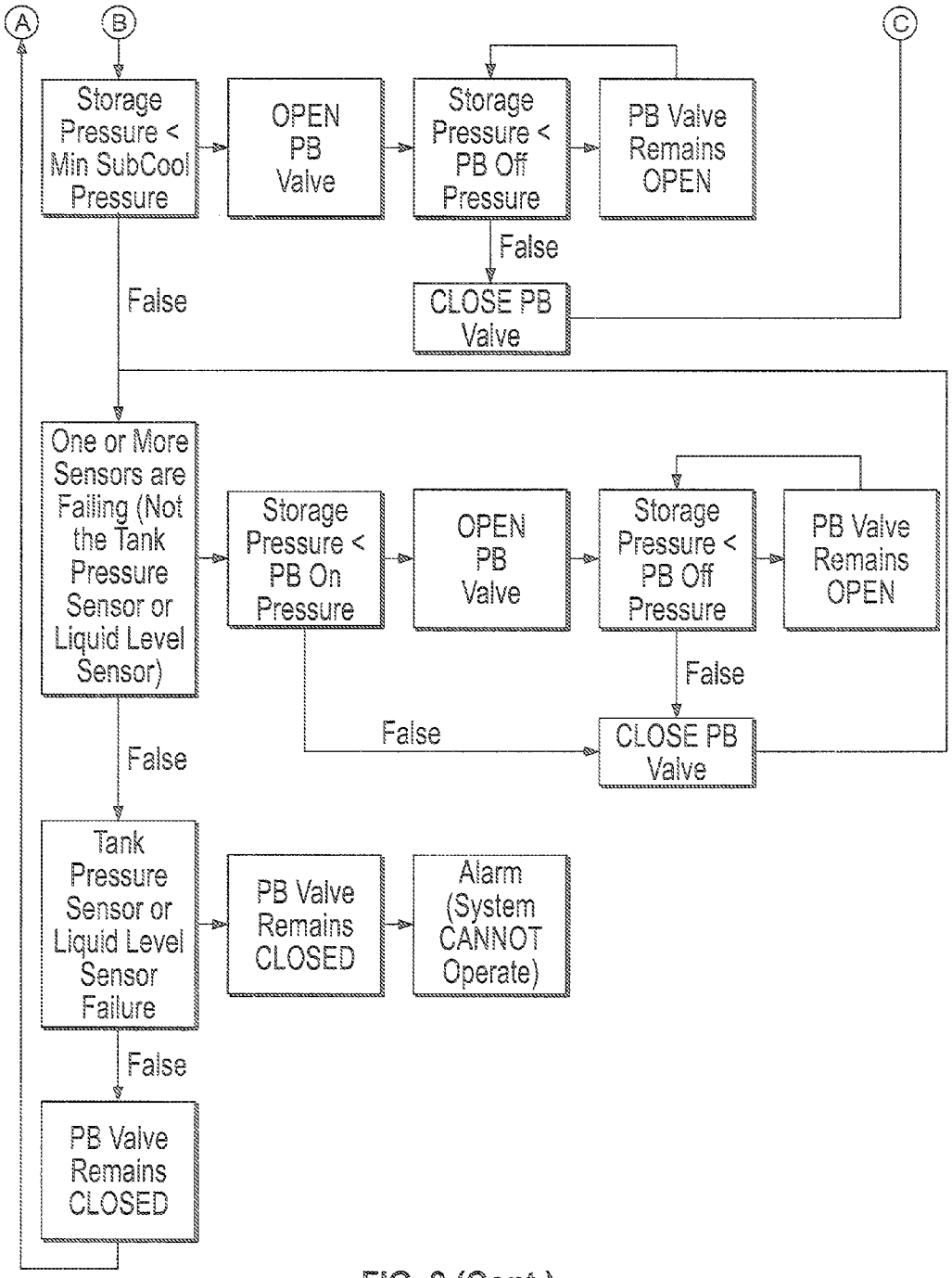

Flowcharts illustrating examples of the processing performed by the PLC 300 of FIG. 6 are provided in FIGS. 8 and 9, where FIG. 8 illustrates processing performed with regard to control of the vent valve 244 and FIG. 9 illustrates processing performed with regard to the pressure building valve 266.

The system 200 is designed to run in two different modes, "Optimized" and "Basic." In Optimized mode, which is described above, the PLC 300 does all of the necessary calculations to deliver saturated liquid to the delivery point. The Basic mode is used if the liquid outlet/dispensing line temperature sensor 288 experiences a failure. It is a fall back mode to continue operation with simplified programming. The Basic mode is designed to deliver liquid at a constant outlet pressure (which may not necessarily be saturation pressure) from the tank. Both of these modes operate with the dynamic pressure builder.

In Optimized mode, the system has the option to incorporate a "black out" period. In many food freezing applications, a cryogenic liquid supply system will operate for 16 hours and then have an 8 hour period of non-use. This time is used to clean and disinfect the freezing chambers. This time is referred to as the black out period. During the black out period the operator has the opportunity to lower the saturation pressure of the stored liquid if it is necessary. That is, the system incorporates another key feature in its design, the automatic liquid de-saturation cycle. If the user has blackout (non-use) time periods programmed into the PLC 300, the vent valve can automatically be directed to open and blow down the tank to conditions to or even below the desired outlet pressure. Once the vent valve closes, the pressure builder can turn on and create the desired amount of sub-cool (the difference between the vapor pressure and the saturation pressure of the liquid). This feature is desirable in applications with erratic usage patterns that cause the liquid to take on heat (from being idle) and for those where consistent liquid quality is critical for the application. This feature is primarily driven by the PLC input from the actual liquid nitrogen temperature in the bottom of the tank (from the saturation pressure sensor 292).

To control the outlet pressure at the bottom of the tank during the refill process (which uses vent and refill lines 220 and 222), the driver still follows their normal procedure of adjusting the top and bottom fill valves to hit the "instructed fill target pressure" by monitoring the tank pressure gauge. However, the tank pressure gauge shows the liquid pressure at the bottom of the tank (vapor pressure+liquid head), not the traditional low-phase line vapor pressure. Thus, unknowingly, the driver reduces the vapor pressure as the tank is filling, holding the outlet pressure stable without changing their filling procedure. This also keeps the application online and unaffected by a tank refill process.

The system of FIGS. 6-9 described above therefore is well suited to users who consume large amounts of liquid nitrogen at high flow rates or simply want better control of their liquid supply. The system offers is an excellent alternative to a modified standard bulk tank and provides a more productive solution for such users.

Figure 10:
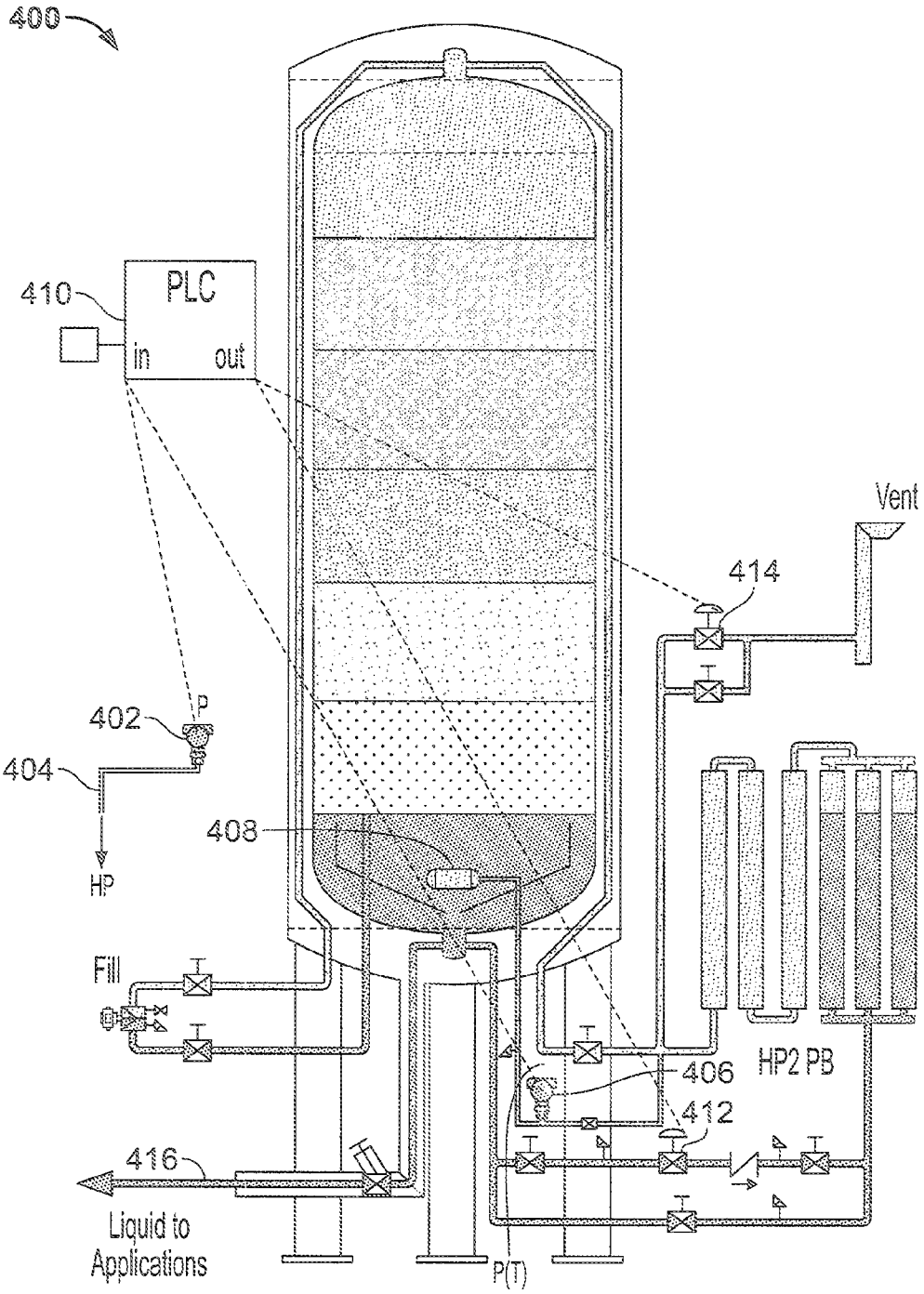
FIG. 10 is a schematic view illustrating an alternative embodiment of the system of the invention.
Figure 11:
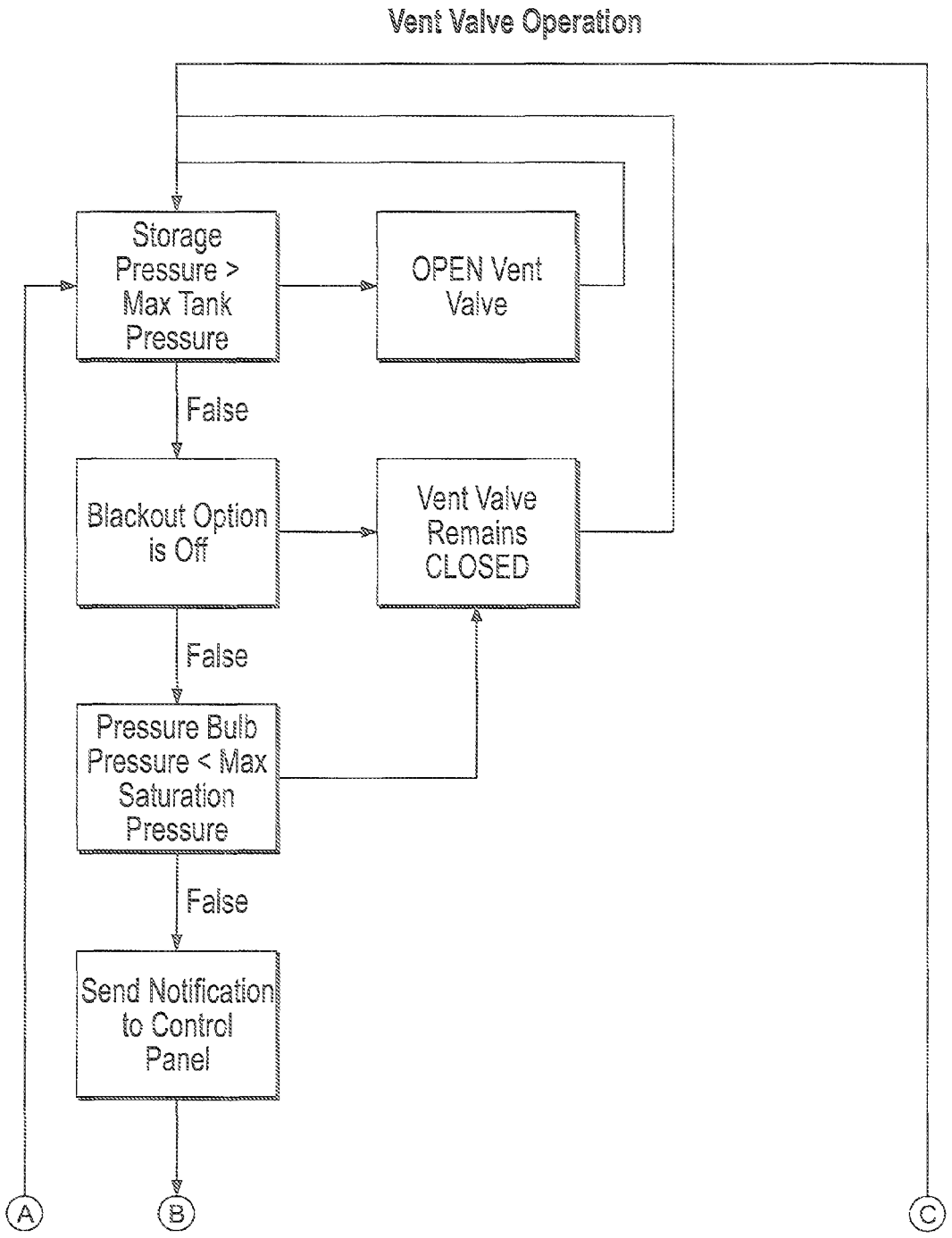
FIG. 11 is a flow chart illustrating the processing performed by the programmable logic controller of the system of FIG. 10 in controlling the vent valve in accordance with an embodiment of the system and method of the invention.
Figure 11:
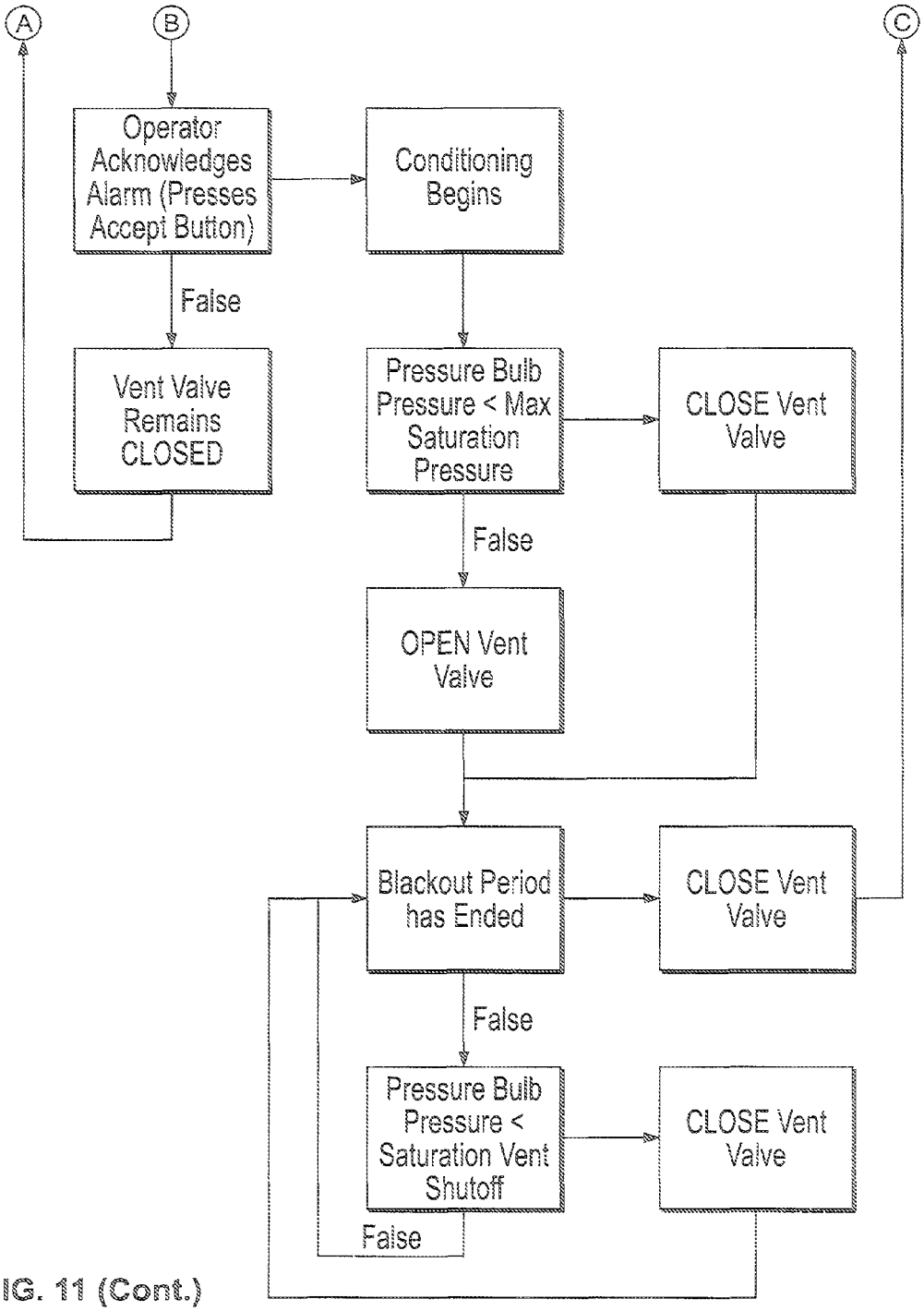
Figure 12:
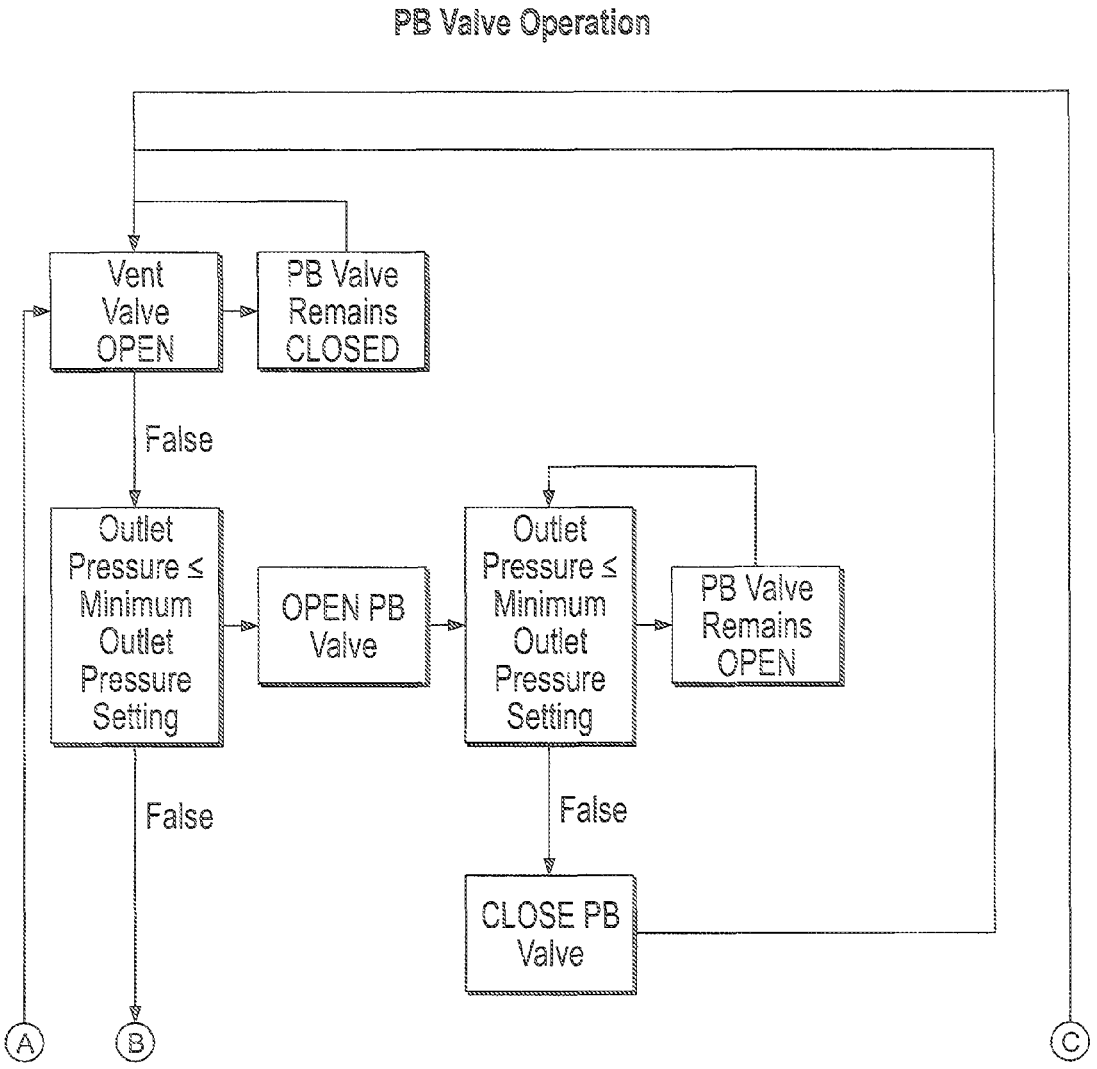
FIG. 12 is a flow chart illustrating the processing performed by the programmable logic controller of the system of FIG. 10 in controlling the pressure building valve in accordance with an embodiment of the system and method of the invention.
Figure 12:
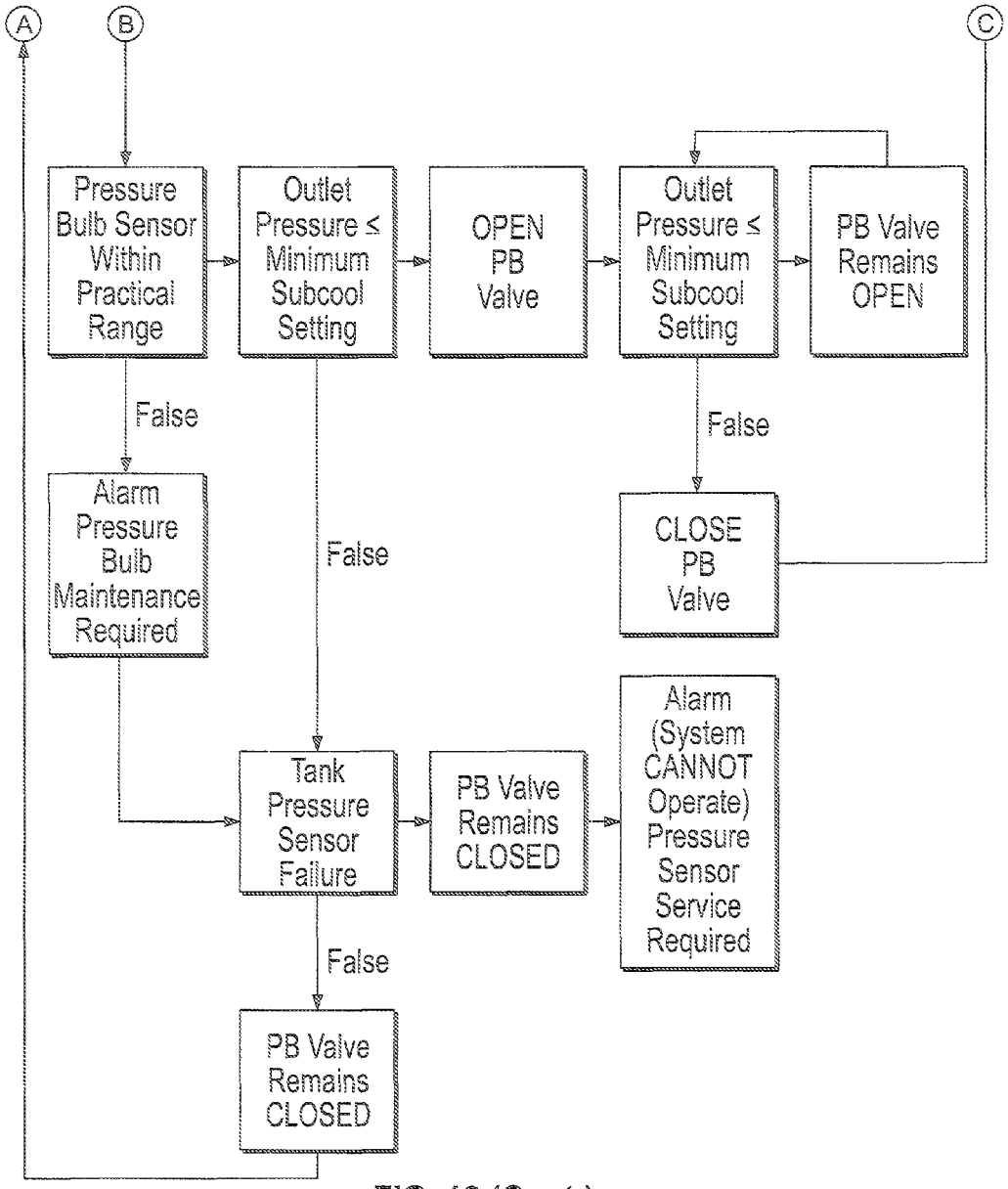

An alternative embodiment of the system is illustrated in FIGS. 10-12. The system, indicated in general at 400 in FIG. 10, features a construction identical to the system of FIG. 6 with the exceptions described below. As illustrated in FIG. 10, the system 400 includes a tank storage pressure sensor preferably in the form of a pressure sensor 402 which communicates with the liquid space of the tank interior via high phase line 404, which leads from the pressure sensor 402 to the bottom of the tank interior. As a result, the pressure sensor 402 provides the storage pressure of the liquid nitrogen at the bottom portion of the tank ($P_{bottom}$).

In addition, the bottom of the tank interior is provided with a saturation pressure sensor 406 that communicates with a pressure bulb 408. The pressure bulb 408 may be a capped pipe inside the bottom of the tank surrounded by liquid. Inside the pipe is gaseous nitrogen. The liquid cools the pipe and condenses the gas inside. The pressure inside the pipe is the saturation pressure of the liquid. The pressure sensor 406 is in communication with the interior of the pipe, and thus provides the saturation pressure of the liquid nitrogen ($P_{sat}$).

Storage pressure sensor 402 and saturation pressure sensor 406 each communicate with a controller, such as programmable logic controller ("PLC") 410 in FIG. 10. The PLC also communicates with, and controls operation of, automated pressure building valve 412 and automated vent valve 414. An example of a suitable PLC is the Allen-Bradley MicroLogix 830 available from Rockwell Automation, Inc. of Milwaukee, Wis. It should be noted that devices other than a PLC, including, but not limited to, pressure switches, may be used as the controller 410.

The PLC performs with the system 400 as a dynamic pressure builder to maintain a constant pressure for the liquid nitrogen flowing through dispensing line 416 by varying the vapor pressure in the tank via the pressure building valve 412 and the vent valve 414. The PLC 410 takes sensor inputs from the storage pressure sensor 402 and the saturation pressure sensor 406 and compares $P_{button}$ with $P_{sat}$ to determine when to operate the pressure builder. For example, if $P_{bottom}$ is below $P_{sat}$, the PLC 410 may open the pressure building valve 412 so that the liquid nitrogen at the bottom of the tank will become subcooled. Alternatively, if the $P_{bottom}$ rises above $P_{sat}$, the PLC 410 may open vent valve 414.

Flowcharts illustrating examples of the processing performed by the PLC 410 of FIG. 10 are provided in FIGS. 11 and 12, where FIG. 11 illustrates processing performed with regard to control of the vent valve 414 and FIG. 12 illustrates processing performed with regard to the pressure building valve 412.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing a cryogenic liquid comprising:

a. a bulk tank defining an interior that is adapted to contain a supply of the cryogenic liquid, said bulk tank having a pressure building; outlet in a bottom portion of the interior and a dispensing outlet in the bottom portion of the interior that is separate from the pressure building outlet;

b. a pressure builder having an inlet configured to receive cryogenic liquid from the pressure building outlet of the bulk tank and an outlet in communication with a top portion of the interior of the bulk tank;

c. a liquid dispensing line configured to receive cryogenic liquid from the dispensing outlet of the bulk tank;

d. a storage pressure sensor configured to detect a pressure of a supply of cryogenic liquid contained within a bottom portion of the interior of the bulk tank;

e. a saturation pressure sensor configured to determine a temperature or a saturation pressure in the bottom portion of the interior of the bulk tank;

f. a pressure building valve in circuit between the bottom portion of the interior of the bulk tank and the inlet of the pressure builder;

g. a vent valve in communication with the top portion of the interior of the bulk tank; and h. a controller in communication with the storage pressure sensor, the saturation pressure sensor, the pressure builder valve and the vent valve, said controller programmed to:

i) determine a bottom pressure using data from the storage pressure sensor, ii) determine a saturation pressure of the cryogenic liquid, iii) compare the bottom pressure with the saturation pressure, and iv) open and close the pressure builder valve and the vent valve during dispensing of cryogenic liquid through the liquid dispensing line based on data from the storage pressure and saturation pressure sensors, including compensating for a loss in a liquid head pressure due to a decreasing liquid level of a supply of the cryogenic liquid in the bulk tank during dispensing of the cryogenic liquid through the liquid dispensing line, by raising a pressure set point to turn on the pressure building valve so that cryogenic liquid flowing through the dispensing line is maintained at a generally constant pressure based on the saturation pressure.

2. The system of claim 1 further comprising a liquid fill line in communication with the interior of the bulk tank via a fill line adapted to be connected to a source of liquid for refilling the hulk tank.

3. The system of claim 2 further comprising a fill vent line in communication with the top portion of the interior of the bulk tank, said fill vent line having a distal end adapted to be connected to the source of liquid during refilling of the bulk tank.

4. The system of claim 1 wherein the cryogenic liquid is liquid nitrogen.

5. The system of claim 1 further comprising a baffle positioned in the bottom portion of the interior of the bulk tank.

6. The system of claim 1 wherein the saturation pressure sensor includes a pressure bulb.

7. The system of claim 1 wherein the liquid dispensing line is insulated.

8. The system of claim 1 wherein the pressure builder has a first stage and a second stage.

9. The system of claim 8 wherein the first stage of the pressure builder includes a plurality of parallel heat exchangers.

10. The system of claim 9 wherein the second stage of the pressure builder includes a plurality of series heat exchangers.

11. The system of claim 1 wherein the bulk tank is insulated.

12. The system of claim 1 further comprising:

i. a pressure builder outlet line in communication with the outlet of the pressure builder and the top portion of the interior of the bulk tank; and j. a vent line in communication with the pressure builder outlet line, said vent line including the vent valve.

13. The system of claim 1 wherein the controller is a programmable logic controller.

14. The system of claim 1 wherein the storage pressure sensor is a differential pressure gauge that is also adapted to detect a pressure of a cryogenic vapor in the top portion of the tank and further comprising:

i. a vapor pressure sensor in communication with the top portion of the tank, said vapor pressure sensor also in communication with the controller;

j. a liquid outlet temperature sensor in communication with the liquid dispensing line, said liquid outlet temperature sensor also in communication with the controller;

and wherein said controller is programmed to determine the bottom pressure using a tank liquid temperature from the saturation pressure sensor, a liquid level from the differential pressure gauge and a vapor pressure from the vapor pressure sensor and to determine the saturation pressure using a liquid outlet temperature from the liquid outlet temperature sensor.

15. The system of claim 1 wherein the controller is programmed to use the pressure detected by the storage pressure sensor as the bottom pressure and a pressure detected by the saturation pressure sensor as the saturation pressure.

16. The system of claim 1 wherein the generally constant pressure that is based on the saturation pressure is the saturation pressure.

17. The system of claim 1 wherein the generally constant pressure that is based on the saturation pressure is a pressure above the saturation pressure so that the cryogenic liquid is subcooled.

18. A system for dispensing a cryogenic liquid comprising:

a. a bulk tank defining an interior that is adapted to contain a supply of the cryogenic liquid, said bulk tank having a pressure building outlet in a bottom portion of the interior and a dispensing outlet in the bottom portion of the interior that is separate from the pressure building outlet;

b. a pressure builder having an inlet configured to receive cryogenic liquid from the pressure building outlet of the bulk tank and an outlet in communication with top portion of the interior of the bulk tank;

c. a liquid dispensing line configured to receive cryogenic liquid from the dispensing outlet of the bulk tank;

d. a storage pressure sensor configured to detect a pressure of a supply of cryogenic liquid contained within a bottom portion of the interior of the bulk tank;

e. a saturation pressure sensor configured to determine a temperature or a saturation pressure in the bottom portion of the interior of the bulk tank;

f. a pressure building valve in circuit between the bottom portion of the interior of the bulk tank and the inlet of the pressure builder;

g. a vent valve in communication with the top portion of the interior of the bulk tank; and h. a controller in communication with the storage pressure sensor, the saturation pressure sensor, the pressure builder valve and the vent valve, said controller programmed to:

i) determine a bottom pressure using data from the storage pressure sensor, ii) determine a saturation pressure of the cryogenic liquid, iii) compare the bottom pressure with the saturation pressure, and iv) open and close the pressure builder valve and the vent valve during dispensing of cryogenic liquid through the liquid dispensing line based on data from the storage pressure and saturation pressure sensors, including opening the pressure building valve when a vapor pressure in the top portion of the interior of the bulk tank drops below a set point, v) compensate for a loss in a liquid head pressure by adjusting the set point during dispensing in inverse proportion to a liquid level in the bulk tank so that cryogenic liquid flowing through the dispensing line is maintained at a generally constant pressure based on the saturation pressure.

* * * * *